United States Patent [19]

LeBarge

[11] Patent Number: 4,775,584

[45] Date of Patent: Oct. 4, 1988

[54] JEWELRY HOLDER

[76] Inventor: Joan LeBarge, R.R #2, Bewdley, Ontario, Canada, K0L 1E0

[21] Appl. No.: 41,100

[22] Filed: Apr. 22, 1987

[51] Int. Cl.[4] ..... A44C 7/00; A45C 11/16

[52] U.S. Cl. ..... 428/316.6; 63/30; 428/47

[58] Field of Search ..... 63/30; 248/216.1; 428/47, 316.6, 318.4, 319.9

[56] References Cited

U.S. PATENT DOCUMENTS

| | | | |
|---|---|---|---|
| 569,053 | 10/1896 | Prokop | 428/21 X |
| 3,531,367 | 9/1970 | Karsten | 428/319.9 X |
| 3,719,342 | 3/1973 | Kupersmit | 248/216.1 |
| 3,818,621 | 6/1974 | Hogue et al. | 40/2 R |
| 3,829,150 | 8/1974 | Moore | 428/316.6 X |
| 4,139,667 | 2/1979 | Blue | 428/47 X |
| 4,378,391 | 3/1983 | Allen | 428/178 X |

*Primary Examiner*—Henry F. Epstein

[57] ABSTRACT

The present invention provides a jewelry holder for removably securing a piece of stemmed jewelry and comprises a resilient body portion of a thickness greater than the length of the stem and being sufficiently porous to enable penetration of the stem into the body portion. The material of the body portion is one which has strong rebound properties for tightly gripping around and holding the stem.

3 Claims, 1 Drawing Sheet

JEWELRY HOLDER

FIELD OF THE INVENTION

The present invention relates to a jewelry holder for holding stemmed jewelry such as pierced earrings, broaches and the like, where the jewelry piece is secured by a stem.

BACKGROUND OF THE INVENTION

Most women have a large supply of jewelry most of which is generally hidden away in a jewelry case. Often times it can be difficult to rummage through the case and easily find a particular pair of earrings or the like.

SUMMARY OF THE PRESENT INVENTION

The present invention provides a jewelry holder for receiving and displaying different pieces of stemmed jewelry such as pierced earrings, broaches and the like. More particulary, the jewelry, holder of the present invention comprises a resilient body portion of a thickness greater than the length of the stem which is typically about ¼" with the body portion being sufficiently porous to enable penetration of the stem and having strong rebound properties for tightly gripping on and holding the stem.

As a preferred construction the body portion is made from a tightly packed cellular foam having a high density intermediate layer which provides an audible indication of the stem penetration through the intermediate layer.

BRIEF DISCUSSION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
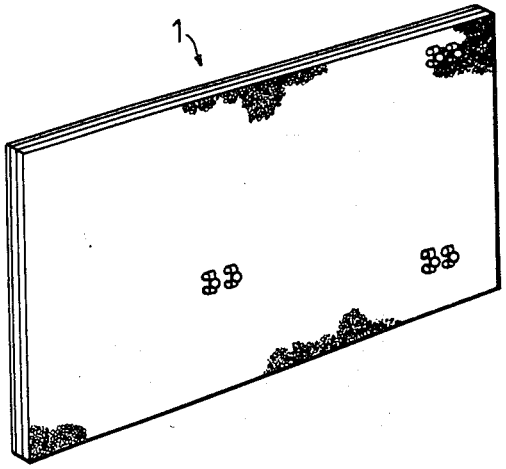
FIG. 1 is a perspective view of a jewelry holder according to a preferred embodiment of the present invention.

In FIG. 1, a jewelry holder generally indicated at 1 is supported by a mounting surface. This mounting surface may actually form part of the holder in the form of a hard backing 11 as shown in FIGS. 2 through 4 or may simply be a wall, mirror or the like with the jewelry holder having a self adhering rear surface for mounting to the wall or mirror.

As will be seen in FIG. 1 numerous pieces of stemmed jewelry such a pierced earrings, broaches and the like are held in the jewelry holder such that they are easily seen and readily available for any desired occasion.

Figure 2:
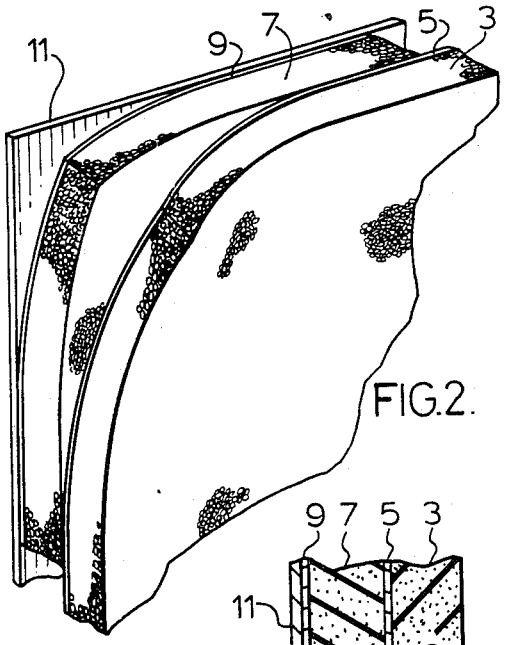
FIG. 2 is an enlarged perspective view of a corner region of the jewelry holder of FIG. 1.
Figure 3:
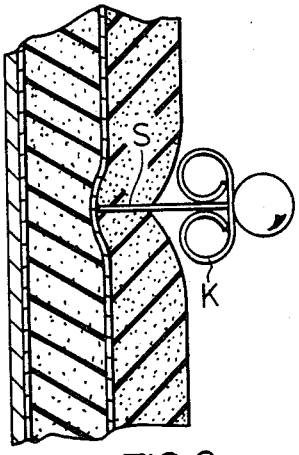
FIG. 3 is a sectional view showing the penetration of a pierced earring into the jewelry holder of FIG. 1.
Figure 4:
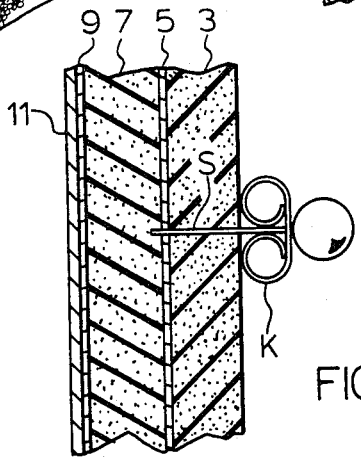
FIG. 4 is a view similar to FIG. 3 with the pierced earring in the secured position and the jewelry holder in a relaxed position.

FIGS. 2 through 4 show a preferred embodiment construction of the jewelry holder which is in the form of a composite body formed by first and second forward and rearward foam layers 3 and 7 separated by a high density plastic film layer 5. Each of the foam layers which in the preferred embodiment is about ¼" thick has a tightly packed cellular construction, which although providing some resistance readily enables penetration of the stem of the jewelry piece.

The actual embedding of the jewelry piece into the holder is well shown in FIG. 3. Here it will be seen that for a typical pierced earing the keeper K is first slid completely along the jewelry piece stem S such that the entire earing is held as an assembled unit rather than having to look for separate pieces of the earing. The stem S is then pushed through the first foam layer 3 until it drives against the thinner high density layer 5. Typcially, this layer is in the form of a thin plastic film about mid way of the composite body, i.e. at a depth of about ¼" which is slightly less than the length of the portion of the stem extending rearwardly of the keeper. This thin film initially resists penetration of the stem and causes a collapsing of the second foam layer 7 until the stem finally breaks through the film layer 5 at which time there is a very noticeable "popping" sound indicating full penetration of the earing stem. This popping sound is a function of the breaking of the high density film and the escape of air trapped in the porous cells of the rearward foam layer 7 and gives a very assured feeling that the earring will not fall out of the holder.

The actual securing the the stem is a result of the strong rebound properties of the foam material which after penetration attempts to return to its original configuration and tightly grips around the stem of the earing. A similar reaction occurs in the film itself which provides a further securing near the end of the stem which actually penetrates into the second or rearward foam layer 7.

The rearward foam layer provides a very special function when the holder is secured to a rigid or hard mounting surface as shown in FIG. 1 in that this rear layers acts as a buffer as seen in FIG. 3 to allow the thin film 5 to be deflected rearwardly until penetrated by the stem of the earring. Without this buffer, the stem would simply push on this thin film layer which would drive up against the mount surface and not allow the penetration of the stem. However, as shown in FIG. 4 once this penetration has been completed the entire composite body including both foam layers and the intermediate plastic film return to a relatively relaxed condition at which point the stem of the earing is firmly held and will not, without pulling, slip out of the holder regardless of its orientation, i.e. even if the holder is inadvertently turned upside down the earring and even a piece of jewelry much heavier than the earing will not dislodge itself under it's own weight.

Again, in the preferrerd embodiment the composite structure of the body is actually formed by two separate pieces of foam material each of which includes a self adhering backing and each piece being about a ¼" in thickness. The backing on the forward foam layer acts as a securing means for holding the two foam layers together and also provides the intermediate thin film of material within the composite body. The backing 9 on the second or rearward foam layer can be covered with silicone paper or the like which is easily removed to allow mounting of the composite structure to any differrent desired surface as earlier described.

All of the description above has related to the preferred embodiment arrangements shown in the drawings. However, it is to be appreciated that other embodiments are also workable according to the present invention. For example, the holder may be formed from a single piece of foam material having a thickness to fully receive the earring or other jewelry piece stem and having strong rebound properties for securing that stem without requiring the use of any intermediate popping layer or the like. Therefore, although various preferred embodiments of the invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. An earring holder for removably securing a stem of an earring, said earring holder comprising a tightly packed cellular foam body having a forwardly exposed foam surface and a thin film of plastic set at a maximum depth of ¼ inch into said foam body portion, said thin film of plastic providing an audible popping sound when penetrated by the earring stem and said foam body portion having strong rebound properties for tightly gripping around and holding the stem.

2. An earring holder as claimed in claim 1, wherein said foam body portion comprises two foam layers of at least substantially equal thickness separated by said film of plastic.

3. An earring holder for removably securing a stem of an earing, said earing holder comprising a tightly packed cellular foam body having a soft readily penetrable forward surface and a thin high density flexible layer set a maximum depth of ¼" into said foam body portion, said thin high density flexible layer providing an audible indication when penetrated by the earring stem and said foam body portion having strong rebound properties for tightly gripping around and holding the stem.

* * * * *